US010166592B2

(12) United States Patent
Colosseo et al.

(10) Patent No.: US 10,166,592 B2
(45) Date of Patent: Jan. 1, 2019

(54) METHOD FOR FORMING A SHEET MADE OF AN ALUMINUM ALLOY INTO A COMPONENT OF COMPLEX SHAPE, PARTICULARLY A MOTOR-VEHICLE COMPONENT

(71) Applicant: C.R.F. Societa Consortile per Azioni, Orbassano (Turin) (IT)

(72) Inventors: Marco Colosseo, Orbassano (IT); Daniele Bassan, Orbassano (IT)

(73) Assignee: C.R.F. Societa Consortile per Azioni, Orbassano (Turin) (IT)

( * ) Notice: Subject to any disclaimer, the term of this patent is extended or adjusted under 35 U.S.C. 154(b) by 748 days.

(21) Appl. No.: 14/599,653

(22) Filed: Jan. 19, 2015

(65) Prior Publication Data

US 2015/0231686 A1 Aug. 20, 2015

(30) Foreign Application Priority Data

Feb. 17, 2014 (EP) ..... 14155342

(51) Int. Cl.

| | |
|---|---|
| ***B21D 53/88*** | (2006.01) |
| ***B21D 37/16*** | (2006.01) |
| ***C25D 13/12*** | (2006.01) |
| ***B21D 26/021*** | (2011.01) |

(52) U.S. Cl.
CPC ..... *B21D 53/88* (2013.01); *B21D 26/021* (2013.01); *B21D 37/16* (2013.01); *C25D 13/12* (2013.01); *Y10T 29/49622* (2015.01)

(58) Field of Classification Search
CPC ..... B21D 53/88; B21D 26/021; B21D 37/16; C25D 13/12; Y10T 29/49622
See application file for complete search history.

(56) References Cited

U.S. PATENT DOCUMENTS

| | | | | |
|---|---|---|---|---|
| 3,373,585 | A | 3/1968 | Reynolds | |
| 7,112,249 | B2 * | 9/2006 | Schroth | B21D 26/021 148/511 |
| 2011/0239721 | A1 | 10/2011 | Carter et al. | |

FOREIGN PATENT DOCUMENTS

| | | |
|---|---|---|
| GB | 1110401 | 4/1968 |

OTHER PUBLICATIONS

European Search Report for International Application No. 14155342.0 dated Sep. 10, 2014, 4 pages.

* cited by examiner

*Primary Examiner* — John C Hong
(74) *Attorney, Agent, or Firm* — RMCK Law Group, PLC

(57) ABSTRACT

A method for forming a sheet made of an aluminium alloy into a component of complex shape, particularly a motor-vehicle component, such as an outer panel or an inner frame of a bonnet or a door of a motor-vehicle, provides for blow-forming of the sheet, with the aid of pressurized gas, within a mould. The alloy constituting the sheet does not have superplasticity features and the sheet and/or the mould are heated to a temperature in the order of 400°-450° C. for 5XXX series alloys and 450°-500° C. and over for 6XXX and 7XXX series alloys. The maximum pressure reached by the forming gas is in the order of 20-30 bars and the time required for forming the sheet is between 40 and 150 seconds and therefore is consistent with production rates in the automotive field.

19 Claims, 6 Drawing Sheets

METHOD FOR FORMING A SHEET MADE OF AN ALUMINUM ALLOY INTO A COMPONENT OF COMPLEX SHAPE, PARTICULARLY A MOTOR-VEHICLE COMPONENT

Cross Reference to Related Applications

This application claims priority to European Patent Application No. 14155342.0 filed on Feb. 17, 2014, the entire disclosure of which is incorporated herein by reference.

FIELD OF THE INVENTION

The present invention relates to a method for forming a sheet made of an aluminium alloy into a component of complex shape, particularly a motor-vehicle component, such as the outer panel or the inner frame of a bonnet or a door of a motor-vehicle.

In particular, the invention relates to a method of the type comprising the following steps:

- providing a mould for blow-forming said sheet of aluminium alloy with the aid of a pressurized gas,
- heating said sheet and/or said forming mould to a predetermined temperature,
- arranging the sheet within the mould, closing the mould and introducing pressurized gas within a chamber of the mould, with a first face of the sheet facing this chamber, so that the sheet is pushed against the surface of the mould towards which the second face of the sheet is facing,
- removing the sheet formed thereby from the mould and subjecting the sheet to heat treatment.

PRIOR ART

Methods of the above indicated type have already been proposed and used in the past in order to obtain components made of aluminium alloy and having a relatively complex shape.

The technical problem which is encountered in these methods is that the aluminium alloys have an elongation which is relatively low and anyway lower than that of steel, so that in general the use of sheet blanks of greater thickness is required, which penalizes production costs and lightness of the finished product.

Due to the reduced elongation of aluminium alloys, the most conventional methods, in which the sheet is heated and formed by mechanical compression between two opposite mould elements, cannot be used for forming components of complex shape.

In order to overcome this problem, in general blow-forming methods of the above described type are preferred, in which the pressure of the forming gas is kept at a relatively low value, in the order of a few bars, and the required forming action is obtained in a very long time, approximately of 1-2 hours. However process times of this amount can be accepted in such fields as that of aerospace and aeronautical industry, but are absolutely inconsistent with very high production rates as those characterizing the automotive field.

Very high forming speed could be obtained through the use of superplastic materials and with substantially higher pressures, starting from 85 bars up to above 200 bars, but at the cost of a more complex and more expensive process. Superplastic materials are poly-crystalline solids capable of reaching large deformations without breaking. By superplasticity the extraordinary ductility is meant which some metal alloys, among which the aluminium alloys, exhibit when the alloy production process takes place under particular conditions. The elongation at breaking which is possible to reach in superplastic conditions is greater than 200%, and in some cases can even pass 1000%. These properties have generated a considerable commercial interest in superplastic forming of components by techniques similar to those developed for forming thermoplastic materials. However, in order to obtain superplastic properties, the starting material must have a micro-structure with a fine and stable grain, which can be obtained by specific preparation techniques of the materials. At the same time, after the sheet forming process, it is also necessary to provide for a further treatment of the materials, in order to restore the desired micro-structure.

OBJECT OF THE INVENTION

The object of the present invention is that of providing a method for producing components of aluminium alloy having a complex shape, with no need of using superplastic materials as starting materials, which is compatible with the requirements of the automotive field, i.e. which anyway ensures the possibility of obtaining a component of complex shape starting from a sheet having a relatively reduced thickness (and hence reduced weight), and involving process times which also are relatively reduced and consistent with production rates in the automotive field.

SUMMARY OF THE INVENTION

In view of achieving this object, the invention provides a method for forming a sheet made of an aluminium alloy into a component of complex shape, particularly a motor-vehicle component, said method having the features which have been indicated at the beginning of the present description and further being characterized in that:

- the aluminium alloy of which said sheet is made does not have superplasticity features,
- said predetermined heating temperature is in the order of approximately 400-550° C.,
- the maximum pressure reached by the forming gas is in the order of 20-30 bars,
- the time required for forming said sheet within the mould is between 40 and 150 seconds,
- in a first part of the forming step, the pressurized gas is fed into said chamber of the mould while leaving that peripheral portions of the sheet which are held by the mould are able to slide with respect to the mould, so as to enable a first forming of the sheet with no substantial elongation of the sheet, and thereafter, in a second part of the forming step, this sliding movement is prevented and the pressurized gas is kept to be fed into said chamber so as to press the sheet against the mould wall, thus causing an elongation of the sheet until it reaches its final shape.

In the preferred embodiment, said predetermined heating temperature is in the order of 400-450° C. if the alloy which is used belongs to the 5xxx series, and is of 450-550° C. or above for alloys of the 6xxx and 7xxx series.

Studies and texts conducted by the applicant have shown that, due to these features, the method of the invention enables the final complex shape of the sheet to be obtained with the use of a sheet of a relatively reduced thickness (which gives the advantage of an inexpensive production and lightness of the finished component). There is no need of the process complications which are necessary with the use of superplastic materials. Moreover process times become consistent with the production rates of the automotive field.

In a preferred embodiment, the value of the pressure of the gas fed into said chamber of the mould is increased by steps during the forming process. For example, the pressure of the gas is kept constant at a first value during said first part of the forming step in which the sheet is free to slide with respect to the mould, and then is brought to a second value greater then said first value and kept at said second value during the second part of the forming step in which the sheet is no longer free to slide with respect to the mould. Preferably, in a final part of the forming step, the pressure of the gas is increased up to a third value, greater then said second value, and kept constant at this third value until the end of the forming process. For example, said first value, said second value and said third value of the pressure of the forming gas are respectively 10, 20 and 30 bars, approximately.

In one embodiment, the method according to the invention is further characterized in that:

said mould comprises:

- a cell within which said sheet is clamped, said cell defining said chamber for introduction of pressurized gas, towards which said first face of the sheet is facing, and
- a forming male member or punch, towards which the second face of the sheet is facing,
- said cell being vertically movable with respect to the punch, in the first part of the forming step, said cell is in a lifted position with respect to the punch and pressurized gas is fed into said chamber while leaving that peripheral portions of the sheet which are held within the cell can slide with respect thereto, so as to enable said first forming of the sheet to take place with no substantial elongation of the sheet,

- in the second part of the forming step, said sliding movement is prevented and pressurized gas is kept to be fed into said chamber while the entire cell is lowered so as to press the second face of the sheet against said punch until the final form of the sheet is obtained.

In cases in which the method is used for forming a motor-component having a face which is exposed to view in the final mounted condition on the motor-vehicle, said first face of the sheet, which faces the chamber where gas is fed, is that which is to be exposed to view in the final mounted condition on the motor-vehicle. In this manner, this face of the sheet is not pressed in contact against a surface of the mould during the forming process, whereby there is no risk that surface defects are induced which may jeopardize the good quality of the surface from the aesthetical point of view.

Furthermore, the method according to the invention is also consistent with the use of starting sheets which have areas of different thickness distributed patchily (obtained during milling of the sheet by using milling rollers having a corresponding shape) or distributed along the longitudinal direction of the mill (obtained by varying the gap between the milling rollers during milling of the sheet). These technologies are useful for obtaining components which include strength portions in one piece at areas which are to be subjected to greater forces. In this case, according to the invention, the sheet is provided with one smooth face while the other face has localized projections at the areas of greater thickness. The sheet is provided within the mould with said face having localized projections facing towards the chamber into which the forming gas is introduced, so that said strength portions are not pressed against the surface of the mould during the forming process.

In this manner, the method according to the invention enables components in one piece to be obtained, with no need of assembling strength elements onto the formed components at areas which are subjected to higher forces.

BRIEF DESCRIPTION OF THE DRAWINGS

Further features and advantages of the present invention will become apparent from the description which follows with reference to the annexed drawings, given purely by way of non-limiting example, in which.

DESCRIPTION OF PREFERRED EMBODIMENTS OF THE INVENTION

Figure 1A:
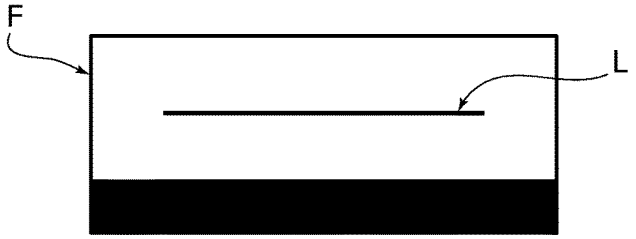
FIGS. 1A-1G show the different steps of a method for forming an aluminium sheet with the aid of pressurized gas, according to the prior art.
Figure 1B:
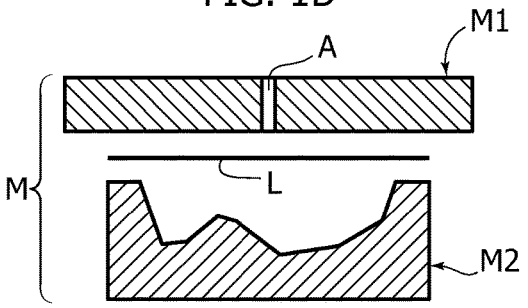
Figure 1C:
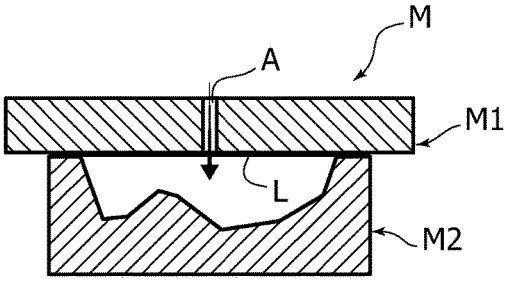
Figure 1D:
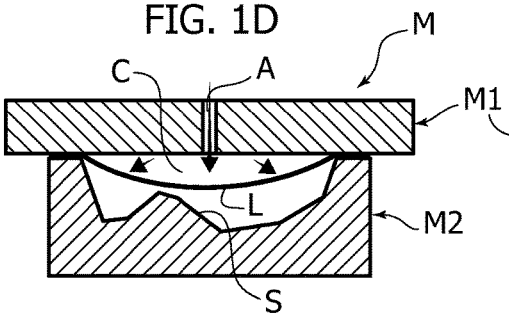
Figure 1E:
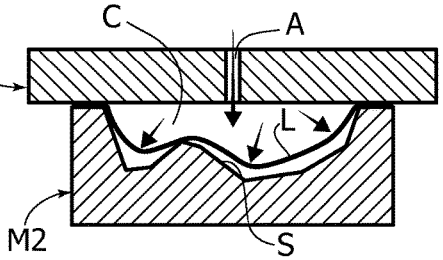
Figure 1F:
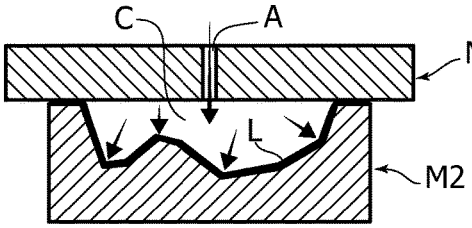
Figure 1G:
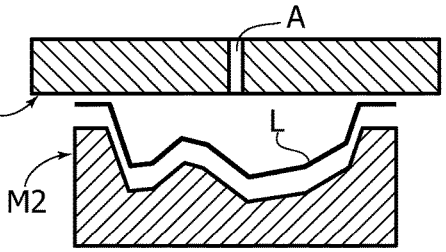

FIGS. 1A-1G show the main steps of a method according to the prior art, for heat blow-forming, with the aid of pressurized gas, of components made of aluminium alloy. A sheet L of aluminium alloy is pre-heated in an oven F up to a temperature which in the known methods is in the order of 500° C. Also in the case of these known methods, the aluminium alloy which is used is typically a special alloy such as SPF 5083. The sheet L is clamped between the upper element M1 and the lower element M2 of a forming mould M (FIGS. 1B, 1C). Through a passage A of the mould upper element M1 there is introduced inert gas (such as nitrogen) at a pressure which, in the case of the known methods, is in the order of 2-5 bars (superplastic forming) or over 85 bars (quick plastic forming). The gas is introduced into a chamber C defined between sheet L and the mould upper element M1 (FIG. 1D). The sheet L has a first face facing chamber C and a second face facing the forming surface S of the lower element of mould M2. The pressurized gas presses sheet L against said surface S until the desired final shape is obtained (FIGS. 1E, 1F) within a time in the order of 1-2 hours. Once forming has been accomplished, the mould is opened (FIG. 1G) and the finished component L is removed and subjected to heat treatment.

FIGS. 2A-2D show the main steps of one embodiment of the method according to the invention.

First of all, the method according to the invention is conceived for being applied to standard aluminium alloys commonly available on the market and generally used in the automotive industry, such as AA5083, AA6016 and AA7075 alloys (differently from the above described known methods which require the use, as indicated, of special alloys).

Figure 2A:
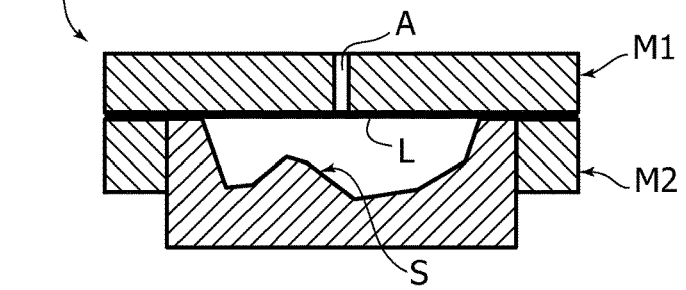
FIGS. 2A-2D show the main steps of the method according to the invention.
Figure 2B:
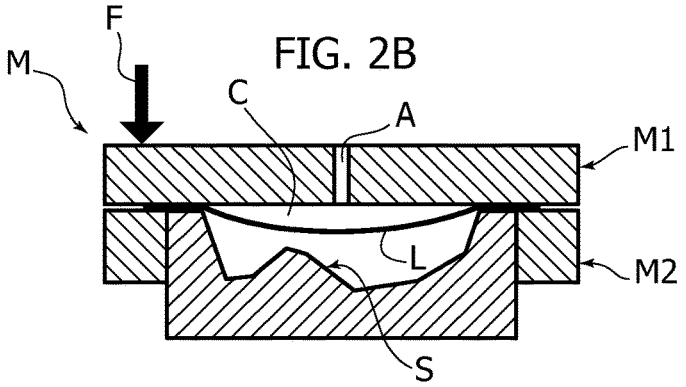
Figure 2C:
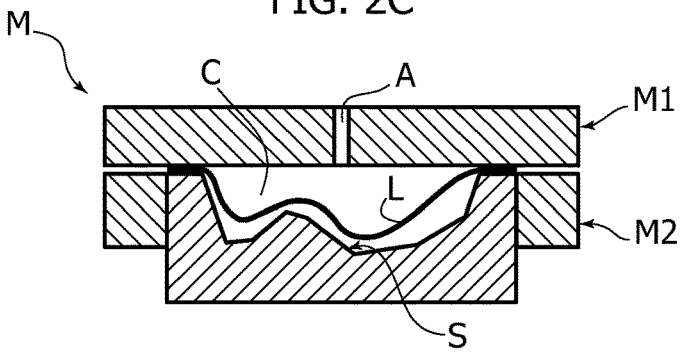
Figure 2D:
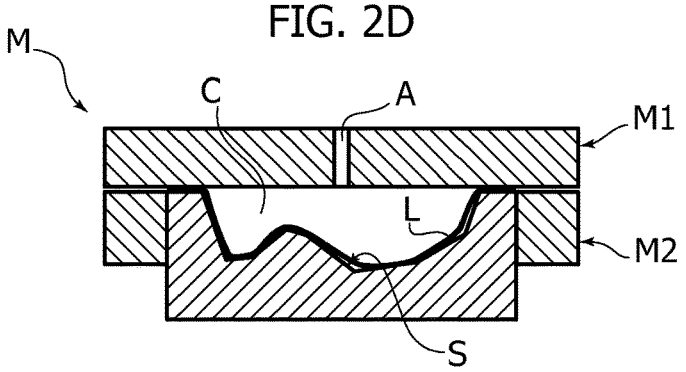

Also in the case of the invention the sheet L and/or the mould M are heated, to a temperature which in the case of the invention is in the order of 500° C. Also in this case the sheet L is formed by pressing it against the surface S of the mould lower element M2 by introducing pressurized gas into chamber C defined between sheet L and the first mould element M1, through the passage A formed in the upper mould element M1. However, in the first part of the forming step, the first mould element M1 and the second mould element M2 are pressed against each other with a force F sufficient for ensuring sealing against the pressurized gas within chamber C, but not so high as to prevent a sliding movement of the peripheral portions of sheet L which are pressed between the mould elements M1, M2 with respect to the mould. Due to this measure, during said first step of the forming process, sheet L is formed by the pressurized gas without undergoing an elongation, since the peripheral portions of the sheet L can slide with respect to the mould (FIG. 2B). Once the first part of the forming step, with the sliding movement of the sheet L with respect to mould M, is completed, the two mould elements M1, M2 are pressed against each other with a higher force F, which prevents any further sliding movement of the sheet with respect to the mould, while pressurized gas keeps on to be fed into chamber C until pressing completely the lower face of sheet L against the forming surface S, thereby obtaining the desired shape of the finished component (FIGS. 2C, 2D).

Figure 3:
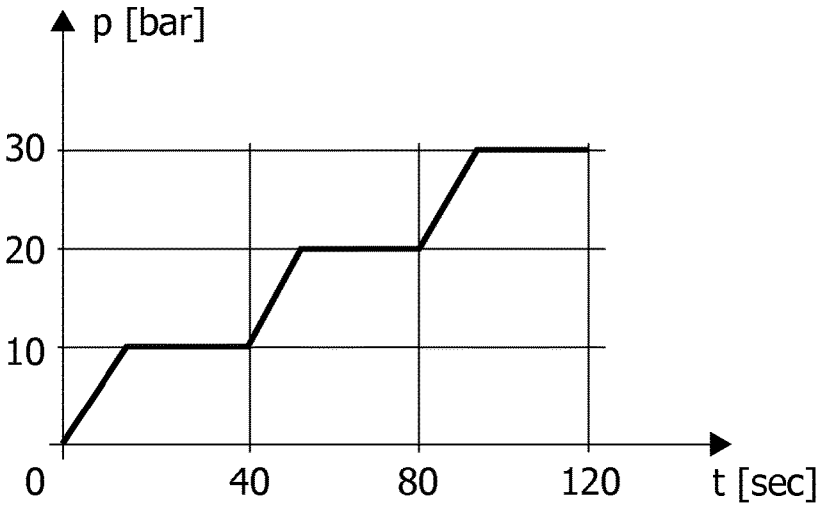
FIGS. 3, 4 are diagrams showing the operative parameters of an embodiment of the method according to the invention.
Figure 4:
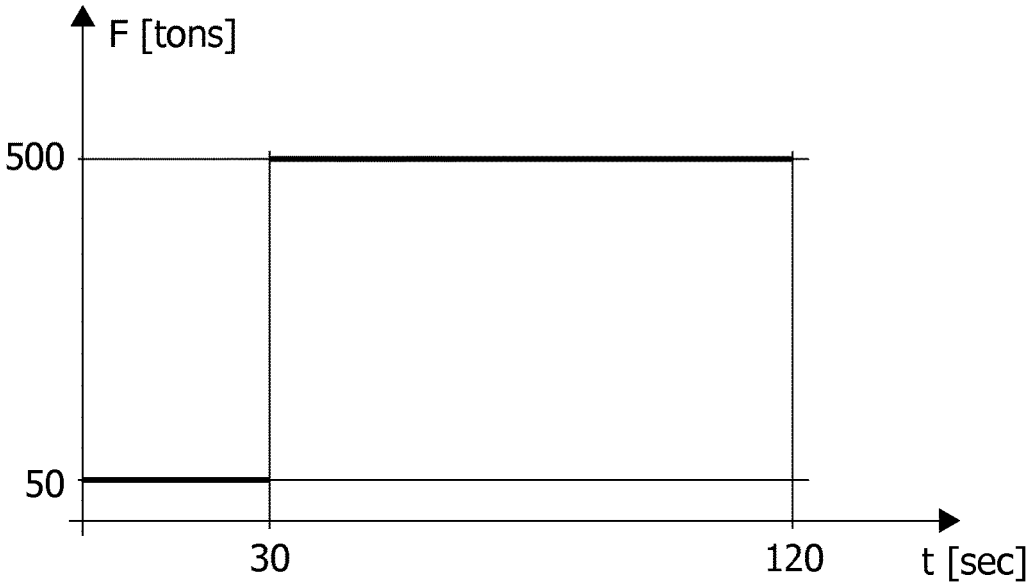

FIGS. 3, 4 are diagrams which show the operative parameters of the above described process. FIG. 3 shows the variation of the pressure of the forming gas during the forming step. As shown, the total duration of the forming step is of about 120 seconds and the pressure of the forming gas is increased by steps so that starting from the beginning of the method, the pressure is brought to a value of about 10 bars and kept to this value during a first part of the forming step, lasting about 40 seconds. In the subsequent 40 seconds, the pressure of the gas is increased to a second value of about 20 bars and kept to this value. Finally, in the final part of the forming step, the pressure is brought to a third even higher value, of about 30 bars.

FIG. 4 shows the variation of the force pressing the two mould elements M1, M2 against each other. As shown, during the first forming stage, in which a sliding movement of the sheet with respect to the mould is enabled, force F is relatively low, whereas it is increased in the second part of the forming stage, such as up to a value of about 500 tons (approximately $4.9\times10^6$ N).

Naturally, the figures of the annexed drawings are diagrammatic and do not show the details of construction of the mould elements, which can be made according to techniques known to the skilled men in the art. Also the press is not shown, in which the forming mould is arranged, along with the associated means for causing the relative opening and closing movements of the two mould elements M1, M2, and also with the means for feeding the pressurized gas, which is typically an inert gas, such as nitrogen. Also all the above mentioned features can be provided in any known way.

Figure 5A:
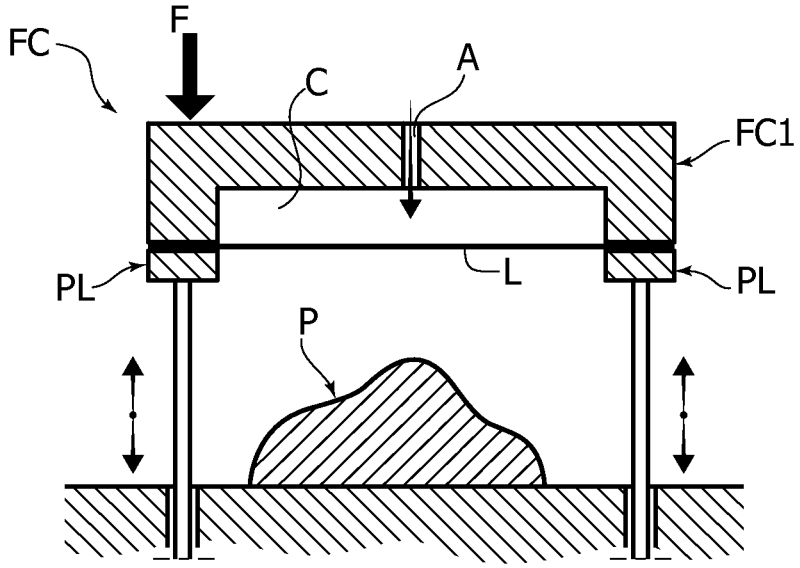
FIGS. 5A-5C show the different steps of the method according to another embodiment of the invention.
Figure 5B:
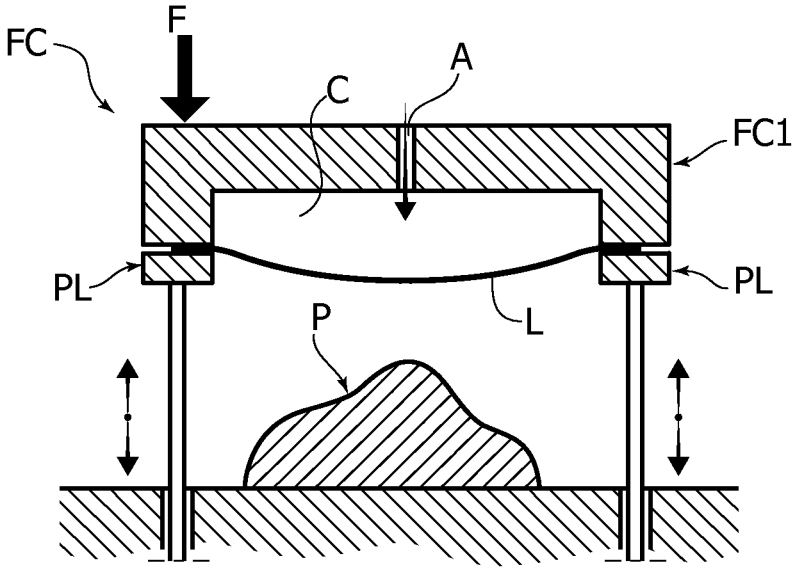
Figure 5C:
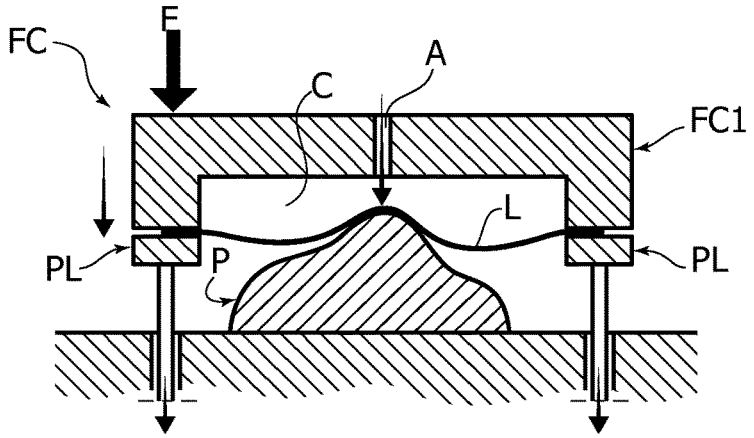

FIGS. 5A-5C show the different stages of a further embodiment of the method according to the invention. In the case of this embodiment, the forming mould comprises a forming cell FC. Sheet L is clamped within this cell. The cell defines chamber C, towards which the upper face of sheet L is facing. Pressurized gas is introduced into chamber C through aperture A, formed in the upper element FC1 of cell FC. The peripheral portions of sheet L are pressed against the upper element FC1 of cell FC by sheet-pressing members PL vertically movable with respect to the upper element FC1 and driven by actuating means of any known type (not shown).

In the case of the embodiment of FIGS. 5A-5C, the forming mould further comprises a forming male member or punch P towards which the lower face of sheet L is facing. The entire structure of cell FC, along with the upper element FC1 and the sheet-pressing elements PL, is vertically movable with respect to punch P. As already indicated for the previously described embodiment, also in this case the details of construction of the cell and those of the press in which the cell is arranged, can be made in any known way. The deletion of these details from the drawings renders the latter simpler and easier to understand.

In the first part of the forming stage, cell FC is held in the lifted position shown in FIG. 5A and pressurized gas is fed to chamber C while enabling a sliding movement of the peripheral portions of sheet L with respect to elements FC1 and PL of cell FC (FIG. 5B). In this manner, in this first part of the forming stage, the sheet L can start to be formed with no elongation. Once this first part of the forming stage is completed, the sheet-pressing elements PL are pressed against the upper element FC1 of cell FC by a higher force F so as to prevent any further sliding movement of sheet L with respect to the mould, after which the entire structure of cell FC, along with the upper element FC1 and the sheet-pressing elements PL is lowered with respect to punch P so as to press the lower face of sheet L against punch P, thus forming the sheet accordingly over punch P. The operative parameters (gas pressure and force F applied to cell FC) as well as the duration of the forming stage may be similar to those shown in FIGS. 3, 4.

In all the above described embodiments, the method according to the invention is particularly adapted to forming components of motor-vehicles bodies, such as bonnets or outer panels of doors or inner frames of doors or bonnets. In the case of components which are to be exposed to view in the final mounting condition on the motor-vehicle, sheet L is arranged within the mould so that its side facing towards the chamber C which is fed with pressurized gas is the face which is to be exposed to view in the final mounted condition on the motor-vehicle. In this manner, during the forming process, there is no risk of formation of surface defects or irregularities on the face of the sheet which is to be exposed to view, which would prejudice quality thereof from the aesthetical point of view.

Figure 6A:
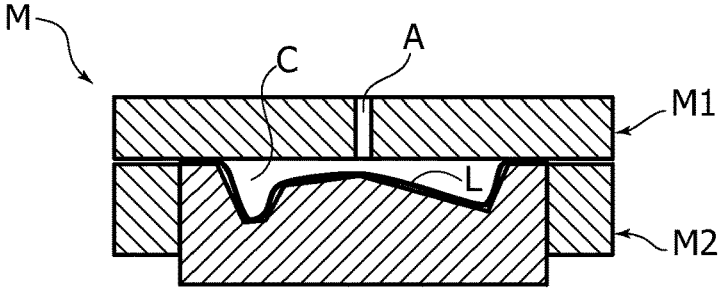
FIGS. 6A-6C show the main steps of a further embodiment of the method of the invention.
Figure 6B:
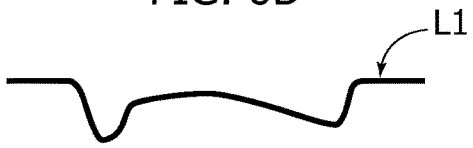
Figure 6C:
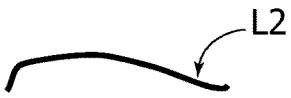

FIGS. 6A-6C show a further embodiment of the method according to the invention, in which a sheet L is formed at a first time into a blank L1 (by a process similar to that shown in FIGS. 2A-2D) whereupon the peripheral portions of blank L1 are cut for obtaining the finished component L2 (FIG. 6C).

Figure 7A:
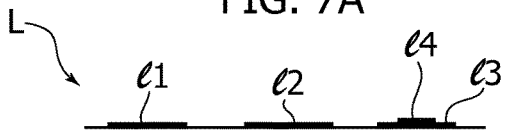
FIGS. 7A-7C show the main steps of a further embodiment.
Figure 7B:
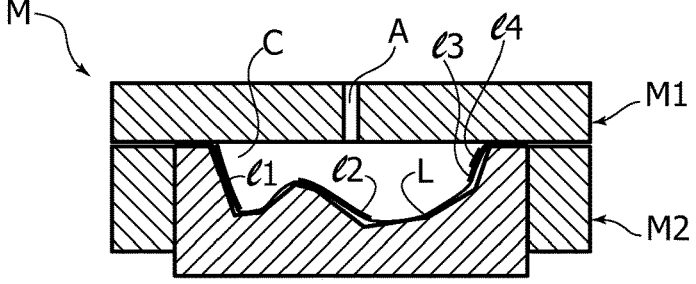
Figure 7C:
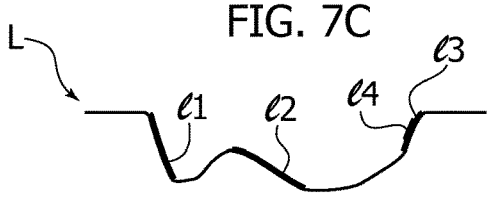

FIGS. 7A-7C show the different steps of a further embodiment of the method according to the invention which differs from that shown in FIGS. 2A-2D only for that in this case the starting sheet L has a plurality of additional portions $I_1$-$I_4$ of enlarged thickness acting as strength portions at localized areas. According to the invention, the sheet has a smooth face and the opposite face having localized projections at said portions with enlarged thickness. The sheet is positioned within mould M with its face with the localized projections facing chamber C during the forming step (FIG. 7B) so that the strength portions $I_1$-$I_4$ are not pressed against the surface S of the mould during the forming step, and a product of complex shape (FIG. 7C) with integrated strength areas is finally obtained. In this manner, the method according to the invention enables components in one piece to be obtained, with no need of mounting strength elements onto the formed components at the areas subjected to higher forces.

Figure 8:
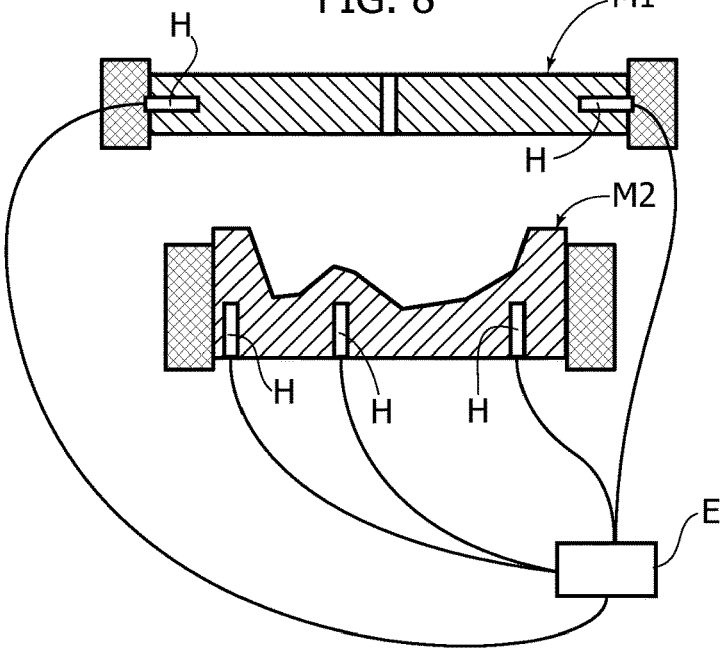
FIG. 8 is a diagrammatic and exploded view of the structure of a mould which can be used in the method according to the invention.

According to a further preferred feature (see FIG. 8) the mould elements may incorporate heating electric elements H supplied with electric current by an electronic control unit E programmed for causing heating of the mould elements according to any predetermined logic, before and during the forming step and if necessary also on the basis of signals indicating the variation of the various operative parameters during the forming step.

In all the embodiments of the invention, once the formed components is obtained, the latter is subjected to a heat treatment according to any known technique. This heat treatment may be chosen by the skilled expert depending upon the type of alloy constituting the sheet.

In the case of components of motor-vehicle bodies, the heat treatment may be obtained simply as a result of the standard process adopted in the motor-vehicle production line for painting the motor-vehicle bodies within electrophoretic cells.

Naturally, while the principle of the invention remains the same, the details of construction and the embodiments may widely vary with respect to what has been described and shown purely by way of example, without departing from the scope of the present invention.

What is claimed is:

1. A method for forming a sheet made of an aluminium alloy into a component of complex shape, which comprises the following steps:

providing a mould for blow-forming said sheet made of aluminium alloy with an aid of pressurized forming gas, heating said sheet made of aluminium alloy and/or said mould to a predetermined heating temperature, arranging, in a forming stage, the sheet within the mould, closing the mould and introducing pressurized forming gas into a chamber of the mould with a first face of the sheet facing this chamber, so that the sheet is pushed against a surface of the mould towards which a second face of the sheet is facing, removing the sheet formed thereby from the mould and subjecting the sheet to a heat treatment, said method being characterized in that:

the alloy constituting said sheet does not have superplasticity features, said predetermined heating temperature is in the order of 400°-550° C., a maximum pressure reached by the forming gas is in the order of 20-30 bars, and a time for forming the sheet within the mould is between 40 and 150 seconds, wherein in a first part of the forming stage, the pressurized forming gas is fed into said chamber of the mould while clamping peripheral portions of the sheet between clamping surfaces of upper and lower elements of the mould with a force sufficient for ensuring sealing against pressurized gas in the mould, but not so high as to prevent a sliding movement of said peripheral portions with respect to said clamping surfaces the mould, parallel to said clamping surfaces, so that said peripheral portions slide relative to said clamping surfaces during said first part of the forming step, thereby enabling a first forming of the sheet without elongation thereof, and thereafter, in a second part of the forming stage, this sliding is prevented and the pressurized forming gas is kept to be fed into said chamber, so as to press the sheet against a wall of the mould, thus causing an elongation of the sheet until it reaches its final shape.

2. The method according to claim 1, wherein the aluminium alloy is a standard alloy of a series 5XXX and said predetermined heating temperature is in the order of 400°-500° C.

3. The method according to claim 1, wherein the aluminium alloy is a standard alloy of a 6XXX or 7XXX series and said predetermined heating temperature is in the order of 450°-550° C.

4. The method according to claim 1, wherein a value of the pressure of the forming gas fed into said chamber of the mould is increased by steps during the forming stage.

5. The method according to claim 4, wherein the pressure of the forming gas fed into said chamber of the mould is kept constant at a first value during said first part of the forming stage in which the sheet is free to slide with respect to the mould and then is brought to a second value greater than said first value and kept at said second value during the second part of the forming stage in which the sheet is not free to slide with respect to the mould.

6. The method according to claim 5, wherein said first value and said second value of the pressure of the forming gas are 10-20 bars and 20-30 bars, respectively.

7. The method according to claim 5, wherein in a final part of the forming stage, the pressure of the forming gas is brought to a third value greater than said second value and is kept constant at this third value.

8. The method according to claim 7, wherein said first value, said second value and said third value of the pressure of the forming gas are respectively about 10, about 20 and about 30 bars.

9. The method according to claim 1, wherein during the second part of the forming stage, in which sliding movement of the sheet with respect to the mould is prevented, peripheral portions of the sheet are pressed between different portions of the mould by a force in the order of $4.9 \times 10^6$ N.

10. The method according to claim 1, wherein said mould comprises a cell within which said sheet is clamped and defining said chamber for introduction of pressurized forming gas, with said first face of the sheet facing said chamber, said mould comprising a forming male-member or punch towards which the second face of the sheet is facing, said cell being vertically movable with respect to said punch, wherein in the first part of the forming stage said cell is in a lifted position with respect to the punch and pressurized forming gas is fed into said chamber while leaving the peripheral portions of the sheet which are clamped within the cell free to slide with respect to the mould so as to enable said first forming with no substantial elongation of the sheet, and wherein in the second part of the forming stage, said sliding is prevented and pressurized forming gas is kept to be fed into said chamber while the cell is lowered so as to press the second face of sheet against said punch until the final shape of the sheet is obtained.

11. The method according to claim 10, wherein said method is used for forming a motor-vehicle component.

12. The method according to claim 11, wherein said method is used for forming a motor-vehicle component having a side which is exposed to view in a final mounted condition on the motor-vehicle and in that said first face of the sheet which is directed towards the chamber where forming gas is introduced is that side to be exposed to view in the final mounted condition on the motor-vehicle.

13. The method according to claim 12, wherein at predetermined areas of said sheet there are provided portions with enlarged thickness, and that the sheet has a smooth second face and the first face has localized projections corresponding to said portions of enlarged thickness, and in that the sheet is arranged within the mould with said first face having the localized projections facing towards the chamber within the mould for introduction of pressurized forming gas.

14. The method according to claim 10, wherein said method is used for forming a motor-vehicle component which is subjected to a painting process by an electrophoresis process, characterized in that the heat treatment of the component after the forming stage is obtained as a result of said electrophoresis process.

15. The method according to claim 1, wherein said method is used for forming a motor-vehicle component which is subjected to a painting process by an electrophoresis process, characterized in that the heat treatment of the component after the forming stage is obtained as a result of said electrophoresis process.

16. The method according to claim 1, wherein said method is used for forming a motor-vehicle component.

17. The method according to claim 16, wherein said method is used for forming a motor-vehicle component having a side which is exposed to view in a final mounted condition on the motor-vehicle and in that said first face of the sheet which is directed towards the chamber where forming gas is introduced is that side to be exposed to view in the final mounted condition on the motor-vehicle.

18. The method according to claim 16, wherein the motor-vehicle component includes an outer panel of a bonnet or a door, or an inner frame of a bonnet or a door.

19. The method according to claim 1, wherein at predetermined areas of said sheet there are provided portions with enlarged thickness, and that the sheet has a smooth second face and the first face has localized projections corresponding to said portions of enlarged thickness, and in that the sheet is arranged within the mould with said first face having the localized projections facing towards the chamber within the mould for introduction of pressurized forming gas.

* * * * *